United States Patent [19]

Urakawa et al.

[11] Patent Number: 4,503,772

[45] Date of Patent: Mar. 12, 1985

[54] GRIPPER PAD HEIGHT ADJUSTING DEVICE FOR SHEET-FED ROTARY PRINTING PRESSES

[75] Inventors: Hidetaka Urakawa; Toshiyuki Aoki, both of Ibaragi, Japan

[73] Assignee: Komori Printing Machine Co., Ltd., Japan

[21] Appl. No.: 368,174

[22] Filed: Apr. 14, 1982

[30] Foreign Application Priority Data

Apr. 21, 1981 [JP] Japan ..... 56-60387
Apr. 21, 1981 [JP] Japan ..... 56-60388

[51] Int. Cl.[3] ..... B41F 1/30
[52] U.S. Cl. ..... 101/409; 101/412
[58] Field of Search ..... 101/246, 409–412, 101/415.1; 271/82, 85, 204, 206, 277

[56] References Cited

U.S. PATENT DOCUMENTS

| | | | |
|---|---|---|---|
| 1,208,731 | 12/1916 | Blaine | 101/412 |
| 1,231,606 | 7/1917 | Henderson | 101/412 |
| 2,734,454 | 2/1956 | Pabst et al. | 101/409 |
| 2,751,006 | 6/1956 | Lane | 101/409 |
| 3,151,552 | 10/1964 | Peyrebrune | 101/409 |
| 3,332,345 | 7/1967 | Smyth | 101/409 |
| 3,388,659 | 6/1968 | Yow-Jiun Hu | 101/269 |
| 3,417,696 | 12/1968 | Koch et al. | 101/409 |

FOREIGN PATENT DOCUMENTS

| | | | |
|---|---|---|---|
| 611993 | 4/1935 | Fed. Rep. of Germany | 101/409 |
| 2713994 | 10/1978 | Fed. Rep. of Germany | 101/409 |
| 2808528 | 9/1979 | Fed. Rep. of Germany | 101/409 |
| 1119100 | 7/1968 | United Kingdom | 101/409 |

*Primary Examiner*—Edgar S. Burr
*Assistant Examiner*—John A. Weresh
*Attorney, Agent, or Firm*—Remy J. VanOphem

[57] ABSTRACT

A plurality of adjustment screws are supported on an adjusting device mounted in a recess in the outer periphery of a cylinder of a sheet-fed rotary printing press, and threadedly extend through an adjustment bar extending axially of the cylinder. A gripper pad bar on which gripper pads are mounted is disposed radially outwardly of the adjustment bar in contact therewith. The gripper pad bar and the adjustment bar are held against each other through their contact surfaces which are complementarily slanted. Rotatable movement of the adjusting screws causes the adjustment bar to displace the gripper pad bar radially outwardly or inwardly for stepless adjustment of the height of the gripper pads in conformity with the thickness of a sheet of paper without having to remove the gripper pad bar and other parts.

27 Claims, 18 Drawing Figures

FIG. 1 PRIOR ART
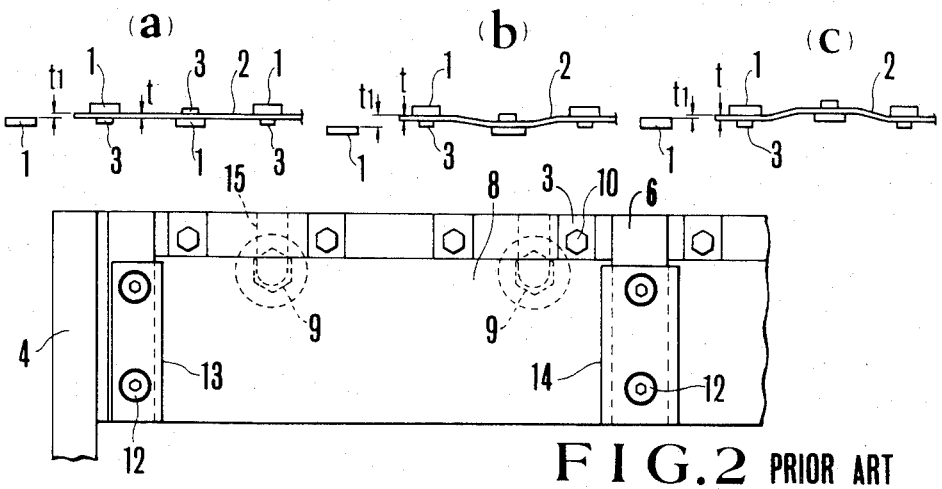
FIG. 2 PRIOR ART
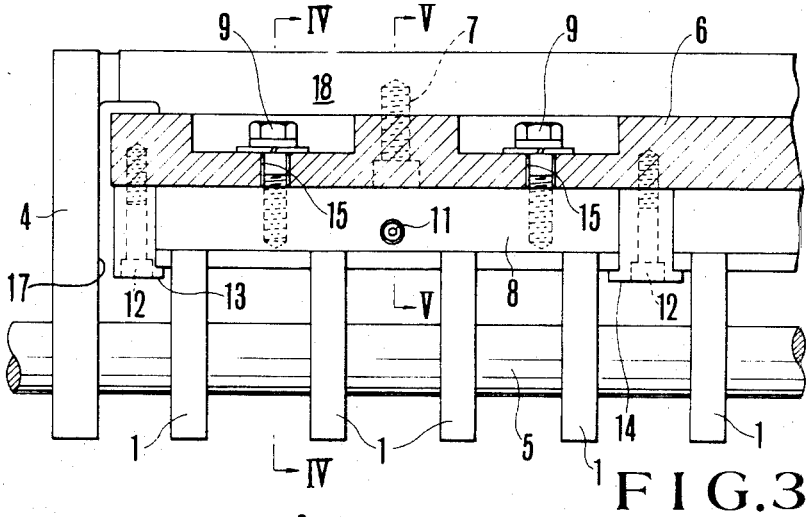
FIG. 3 PRIOR ART
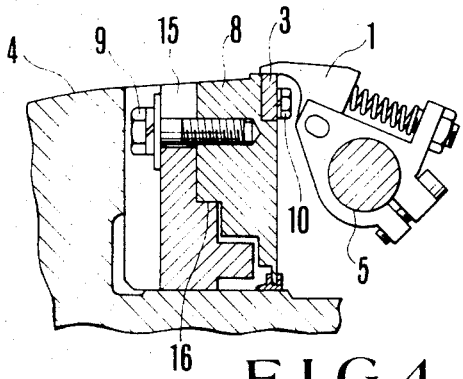
FIG. 4 PRIOR ART
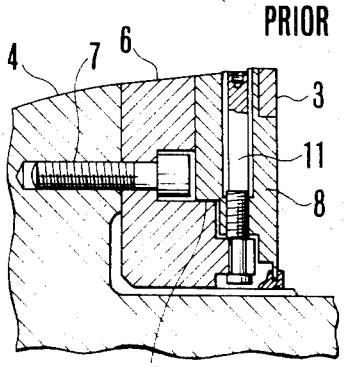
FIG. 5 PRIOR ART

GRIPPER PAD HEIGHT ADJUSTING DEVICE FOR SHEET-FED ROTARY PRINTING PRESSES

BACKGROUND OF THE INVENTION

The present invention relates to a device for adjusting the height of a gripper pad or support dependent on the thickness of a sheet in a sheet-fed rotary printing press.

Sheets of paper supplied by a sheet feeder into a sheet-fed rotary printing press are successively gripped by and between gripper devices disposed in recesses in the outer peripheries of various cylinders such as an impression cylinder, a sheet transfer cylinder, and a sheet delivery cylinder. To prevent sheet damage or other printing troubles, each of the gripper devices is provided with a gripper pad height adjusting device for enabling the gripper device to accommodate various thicknesses of sheet. However, the above referenced prior gripper pad height adjusting device is disadvantageous in that the adjustment procedure is complex and time-consuming. The gripper pad height adjusting device fails to keep a required degree of adjustment precision due to the entry of dust.

SUMMARY OF THE INVENTION

It is an object of the present invention to provide a gripper pad height adjusting device for sheet-fed rotary printing presses which has a simplified structure for adjusting the height of gripper pads that will cooperate with grippers in gripping a sheet of paper.

Another object of the present invention is to provide a gripper pad height adjusting device for sheet-fed rotary printing presses which allows adjustment of the height of a gripper pad in a short period of time.

Still another object of the present invention is to provide a gripper pad height adjusting device for sheet-fed rotary printing presses which prevents dust or foreign matter from entering a liner receiver upon replacement of a liner or shim.

A still further object of the present invention is to provide a gripper pad height adjusting device for sheet-fed rotary printing presses which permits stepless adjustment of the height of gripper pads.

According to the present invention, a plurality of adjustment screws are supported on an inner wall of a recess in the outer periphery of a cylinder, and threadedly extend through an adjustment bar extending axially of the cylinder. A gripper pad bar on which gripper pads are mounted is disposed radially outwardly of the adjustment bar in contact therewith. The gripper pad bar and the adjustment bar are held against each other through their contact surfaces which are complementarily slanted in the transverse direction thereof. Rotatable movement of the adjustment screws causes the adjustment bar to displace the gripper pad bar radially outwardly or inwardly for stepless adjustment of the height of the gripper pads in conformity with the thickness of a sheet without having to remove the gripper pad bar and other parts.

In accordance with an embodiment of the present invention, a gripper pad height adjusting device for sheet-fed rotary printing presses includes a cylinder having a recess in an outer periphery, a plurality of adjustment screws rotatably movably supported on an inner wall of the recess, an adjustment bar held in threaded engagement with the adjustment screws and extending axially of the cylinder, the adjustment bar being responsive to rotatably movement of the adjustment screws for back-and-forth movement in a direction substantially normal to the direction in which the adjustment bar extends, a gripper pad bar extending parallel to and disposed radially outwardly of the adjustment bar, springs urging the gripper pad bar into contact with the adjustment bar, and a plurality of gripper pads mounted on the gripper pad bar, the adjustment bar and the gripper pad bar having confronting contact surfaces which are complementarily slanted transversely thereof for moving the gripper pad bar radially of the cylinder in response to back-and-forth movement of the adjustment bar.

According to a modification of the present invention, a gripper pad attachment bar is fixedly disposed in a recess in an outer periphery of a cylinder and extends axially of the cylinder. An adjustment bar having substantially the same length as the gripper pad attachment bar is movably supported for back-and-forth movement in the direction in which the gripper pad bar extends, the adjustment bar being urged by a spring to move in a longitudinal direction thereof. A gripper pad bar on which gripper pads are mounted is disposed radially outwardly of the adjustment bar in parallel relation therewith. The adjustment bar and the gripper pad bar are held against each other along their surfaces which are slanted longitudinally thereof. When an adjustment screw is rotatably moved, the adjustment bar is moved longitudinally to move the gripper pad bar in the radial direction of the cylinder for stepless adjustment of the height of the gripper pads in conformity with the thickness of a sheet without requiring removal of the gripper pad bar and other components.

In accordance with another embodiment of the present invention, a gripper pad height adjusting device for sheet-fed printing presses includes a cylinder having a recess in an outer periphery thereof, a gripper pad attachment bar fixedly disposed in the recess and extending substantially the full length of the recess, an adjustment bar supported on the gripper pad attachment bar for back-and-forth movement in the direction in which the gripper pad attachment bar extends, a spring urging the adjustment bar in a longitudinal direction thereof, a gripper pad bar disposed radially outwardly of the adjustment bar in parallel relation therewith, the gripper pad bar being held against the adjustment bar and retained against longitudinal movement, a plurality of gripper pads mounted on the gripper pad bar, an adjustment screw for moving the adjustment bar against the bias of the spring, the adjustment bar and the gripper pad bar having confronting contact surfaces which are complementarily slanted longitudinally thereof for moving the gripper pad bar radially of the cylinder in response to back-and-forth movement of the adjustment bar, and a screw member for fixing the gripper pad bar to the gripper pad attachment bar after the gripper pad bar has positionally been adjusted.

The above and other objects, features and advantages of the present invention will become more apparent from the following description when taken in conjunction with the accompanying drawings.

BRIEF DESCRIPTION OF THE DRAWINGS

FIGS. 1(*a*) through 1(*c*) are diagrams showing gripper pads and sheets, explanatory of a need for a gripper pad height adjusting device;

FIG. 2 is a fragmentary front elevational view of a conventional gripper pad height adjusting device disposed in a recess in a sheet transfer cylinder of a sheet-fed rotary printing press;

FIG. 3 is a fragmentary plan view, with parts broken away, of the device shown in FIG. 2;

FIG. 4 is a cross-sectional view taken along line IV—IV of FIG. 3;

FIG. 5 is a cross-sectional view taken along line V—V of FIG. 3;

DETAILED DESCRIPTION

Figure 6:
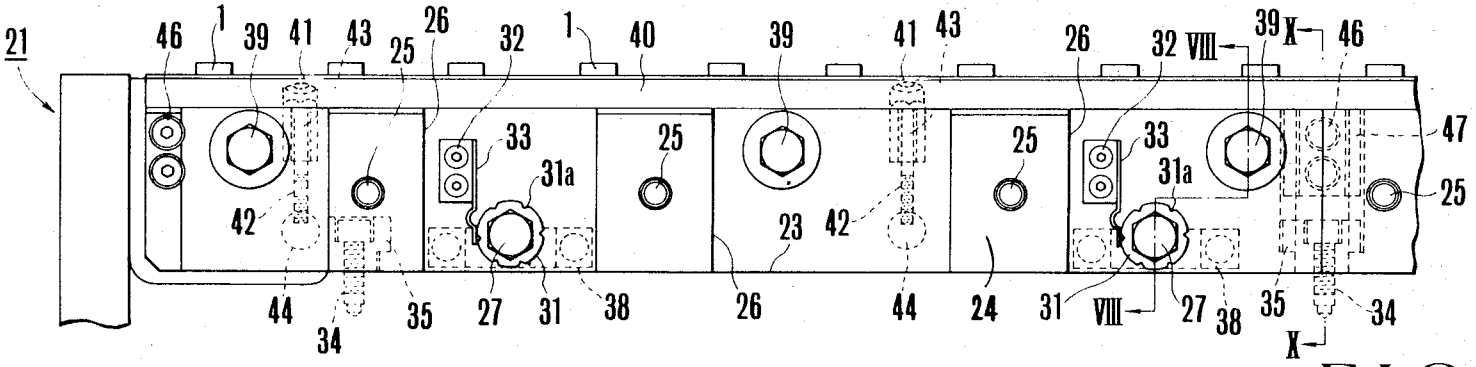
FIG. 6 is a fragmentary front elevational view of a first example of a gripper pad height adjusting device according to the present invention, disposed in a recess in a sheet transfer cylinder of a sheet-fed rotary printing press.
Figure 7:
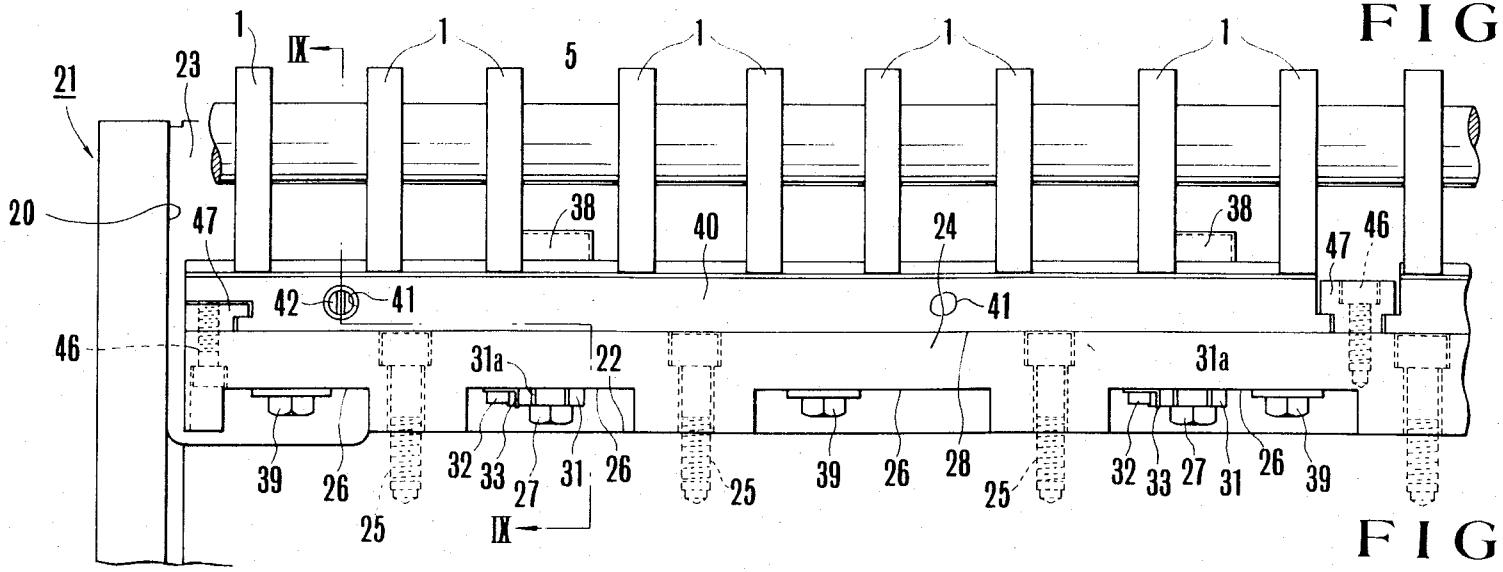
FIG. 7 is a fragmentary plan view of the device shown in FIG. 6.

As illustrated in FIG. 1(*a*), a conventional sheet gripper device mounted on each of various cylinders of a sheet-fed rotary printing press includes a plurality of openable grippers 1 and gripper pads 3 for jointly gripping a sheet 2 of paper therebetween. The grippers 1 and gripper pads 3, mounted on adjacent cylinders for successively gripping the sheet, are axially displaced with respect to each other to prevent mutual interference. When the sheet 2 has a thickness t which is equal to a gap $t_1$ between adjacent gripper pads 3, the sheet 2 is allowed to be kept planar or flat, as shown in FIG. 1(*a*), an ideal condition for printing operation. When the gap $t_1$ is larger or smaller than the thickness t of the sheet, as shown in FIGS. 1(*b*) and 1(*c*), respectively, the sheet 2 tends to become wavy and contracted under transverse tension, with the result that the sheet 2 will be damaged. Various other printing troubles will also result. To prevent such difficulties, a typical prior art sheet gripper device is provided with a gripper pad height adjusting device for adjusting the gap $t_1$ so as to be 0.3 mm when the thickness t of the sheet is 0.3 mm or smaller, and 0.6 mm when the thickness t is in the range of from 0.3 mm to 0.6 mm.

FIGS. 2 through 5 generally illustrate such a known gripper pad height adjusting device. As shown in FIG. 3, plurality of grippers 1 which are openable by a cam mechanism (not illustrated) are mounted at intervals on a gripper shaft 5 disposed in a recess 17 in the outer periphery of a sheet transfer cylinder 4. The recess is partly defined by a wall 18 to which a gripper pad attachment bar 6 is affixed by a bolt 7. A gripper pad bar 8 is secured by bolts 9 to the gripper pad attachment bar 6. A plurality of gripper pads 3 are affixed by bolts 10 to the gripper pad bar 8 in alignment with the grippers 1. After the bolts 9 have been loosened, the gripper pad bar 8 is vertically movable along holders 13 and 14 which are affixed by bolts 12 to the gripper pad bar 8 and along U-shaped grooves 15 in response to the rotation of an adjustment screw 11 threadedly extending through the gripper pad bar 8. A liner or shim 16 illustrated in FIGS. 4 and 5, is inserted between the gripper pad attachment bar 6 and the gripper pad bar 8. The height of the gripper pads 3 can be adjusted upon replacement or removal of the liner 16.

Removal or replacement of the liner 16, however, necessitates detachment of the gripper pad bar 8, resulting in a complex and time-consuming adjusting procedure. The prior art gripper pad height adjusting device is also disadvantageous in that dust or other foreign matter is likely to enter a portion of the device which receives the liner 16 upon replacement of the latter, decreasing the precision with which the gripper pads are adjustable in height.

As shown in FIGS. 6 through 10, a sheet transfer cylinder 21 has in the outer periphery thereof a recess 20 extending the full length of the cylinder, the recess being defined by an inner wall 22 extending radially of the cylinder, and a bottom surface 23 extending normally to the surface of the inner wall 22. A gripper shaft 5 is disposed in the recess 20 and supports thereon grippers 1 which are spaced axially of the gripper shaft 5 and are of the same construction as that of the conventional gripper 1 shown in FIG. 4.

Figure 8:
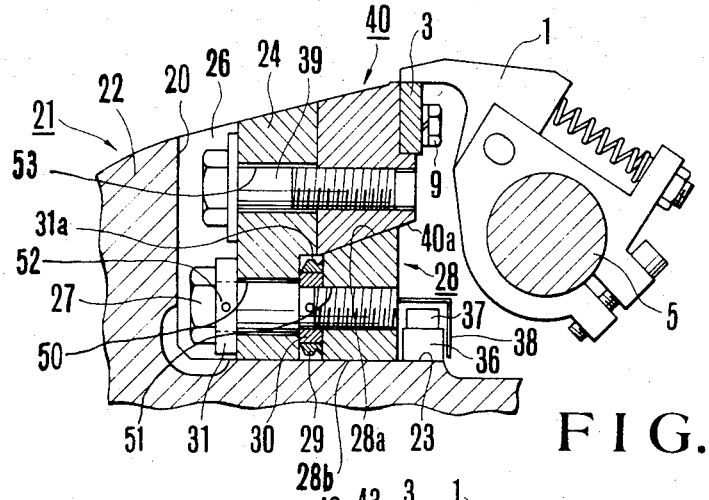
FIG. 8 is an offset partially in section view taken along line VIII—VIII of FIG. 6.
Figure 9:
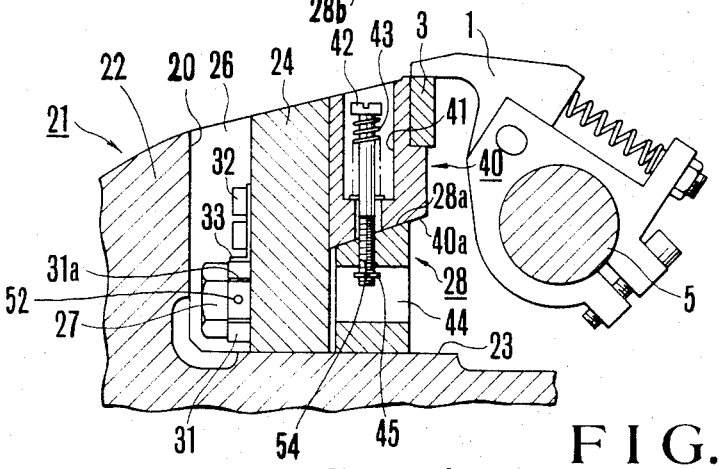
FIG. 9 is an offset sectional view taken along line IX—IX of FIG. 7 and rotated ninety degrees.
Figure 10:
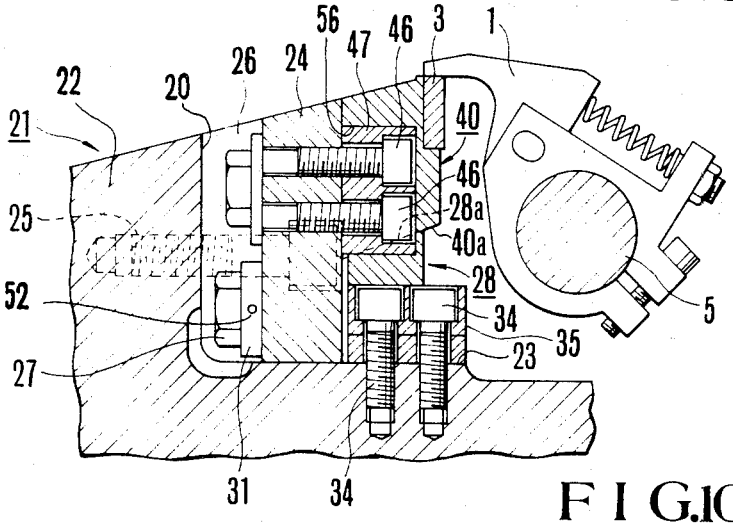
FIG. 10 is a cross-sectional view taken along line X—X of FIG. 6.

A gripper pad attachment bar 24 is affixed to the inner wall 22 by a plurality of bolts 25, the gripper pad attachment bar 24 being of a rectangular cross section and extending parallel to the longitudinal axis of the sheet transfer cylinder 21. The gripper pad attachment bar 24 has a plurality of cavities 26 facing the inner wall 22 and opening to the exterior. As shown in FIG. 8, adjustment screws 27 which are disposed in some of the cavities 26 extend rotatably through holes 50 in the gripper pad attachment bar 24 in perpendicular relation to the inner wall 22. The adjustment screws 27 have projecting threaded ends which threaded into suitable threaded bores 51 in an adjustment bar 28 through collars 30, having V rings 29, for preventing dust from being interposed between the gripper pad attachment bar 24 and the adjustment bar 28 are provided about the adjustment screws 27 intermediate the attachment bar and the adjustment bar.

The adjustment bar 28 is of a cross-section, having a sloping surface, rectangular and extends substantially the full length of the recess 20 in the sheet transfer cylinder 21 in parallel relationship to the longitudinal axis of the sheet transfer cylinder 21. The adjustment bar 28 has a radially inward surface 28*b* held against the bottom surface 23 of the recess 20 in the sheet transfer cylinder 21 and a radially outward surface 28*a* slanted in the transverse direction thereof.

The adjustment screw 27 is prevented from axial displacement by the collar 30 and by a scale ring 31 inserted in the cavity 26. Rotary movement of the adjustment screw 27 causes the adjustment bar 28 to move back-and-forth in a direction substantially normal to the direction in which the adjustment bar 28 extends. The scale ring 31 and the adjustment screw 27 are assembled together by a pin 52, the scale ring 31 having on its outer periphery a plurality of V-shaped notches 31*a* angularly spaced at equal intervals. One of the notches 31*a*, on each of the scale rings 31 receives therein a V-shaped projection on a leaf spring 33 secured by a bolt 32 to an inner wall of each cavity 26.

The adjustment bar 28 has in its lower surface a plurality of T-shaped slots each receiving a holder 35 (FIGS. 6 and 10) which is affixed by bolts 34 to the bottom surface 23 for guiding the back-and-forth movement of the adjustment bar 28. A stop 36 (FIG. 8) is secured by a bolt 37 to the bottom surface 23 to define one limit for the back-and-forth movement of the adjustment bar 28. The stop 36 is provided with a dust cover 38 (FIGS. 7 and 8) for preventing dust from entering an area in which the adjustment bar 28 and the stop 36 will be held in contact with each other.

A plurality of fastening bolts 39 which are disposed in some of the cavities 26 in the gripper pad attachment bar 24 are inserted slightly movably through holes 53 (FIG. 8) in the gripper pad attachment bar 24. Each of the fastening bolts 39 has a projecting threaded end which extends threadedly into a gripper pad bar 40. The gripper pad bar 40 can be secured to the gripper pad attachment bar 24 by fastening the bolts 39. The gripper pad bar 40 has a length which is equal to that of the adjustment bar 28 and also has a parallelogram-like cross section. The gripper pad bar 40 has a slanted surface 40*a* which abuts the slanted outward surface 28*a* and which is slanted transversely in complementary relation to the outward surface 28*a* of the adjustment bar 28.

The gripper pad bar 40 has therein a plurality of bolt holes 41 (FIGS. 6, 7 and 9) extending radially of the sheet transfer cylinder 21 and receiving therein a plurality of adjustment screws 42 which have threaded end portions threaded into threaded bores 54 (FIG. 9) the adjustment bar 28. Each of the adjustment screws 42 has a compression coil spring 43 that urges the gripper pad bar 40 toward the adjustment bar 28. A split pin 45 extends through a distal end of each adjustment screw 42 which is positioned in a circular transverse bore 44 in the adjustment bar 28.

The gripper pad bar 40 has a plurality of T-shaped slots 56 each retaining therein a holder 47 that is affixed to the gripper pad attachment bar 24 by bolts 46. The holders 47 serve to guide the gripper pad bar 40 when the latter is slightly moved radially of the sheet transfer cylinder 21 upon loosening of the fastening bolts 39. A plurality of gripper pads 3, which have the same construction as that of the gripper pads shown in FIG. 4, are mounted on the gripper pad bar 40 by bolts 9 in alignment with the grippers 1.

The gripper pad height adjusting device thus constructed will operate as follows: The gripper pad bar 40 is normally secured by the bolts 39 to the gripper pad attachment bar 24 with the slanted surface 40*a* being pressed against the radially outward surface 28*a* of the adjustment bar 28 under the biasing force of the compression springs 43. When sheets of paper having a different thickness are to be used, it is necessary to change or adjust the height of the gripper pads 3, or the position of the latter in the radial direction with respect to the axis of the sheet transfer cylinder 21, as described with reference to FIG. 1.

To effect such adjustment, the bolts 39 are loosened to make the gripper pad bar 40 and the bolts 39 freely movable slightly. Thereafter, the adjustment screws 27 are rotated about their axes to displace back and forth the adjustment bar 28 threaded on the adjustment screws 27, which are prevented from axial movement by the collars 30 and the scale ring 31. The adjustment screws 27 are turned until the projections on the leaf springs 33 engage in desired V-shaped notches 31*a* in the scale rings 31, which are selected for the thickness of the sheets of paper to be used. The above adjustment is effected on all of the adjustment screws 37 to translate the adjustment bar 28 laterally, whereupon the gripper pad bar 40 is allowed to move radially of the sheet transfer cylinder 21 under the resiliency of the compression springs 43 with the surfaces 28*a*, 40*a* being pressed against each other. Then, the bolts 39 are fastened to fix the gripper pad bar 40 to the gripper pad attachment bar 24 with the gripper pads 3 adjusted in desired height. The adjustment procedure is thus completed.

Movement of the adjustment bar 28 and the gripper pad bar 40 is accurate and smooth as it is guided by the holders 35 and 47. Since the bars 24, 28 and 40 are held in intimate contact with each other during adjustment, and because of the V-rings 29 and the dust cover 38, no dust or other foreign matter finds its way between the contact surfaces 28*a* and 40*a* and into the portions in which the adjustment screws 27 are fitted.

Although in the illustrated embodiment the present invention is shown as being applied to a sheet transfer cylinder, it is also equally applicable to various other cylinders such as an impression cylinder or a sheet delivery cylinder.

With the present invention, as described above, a gripper pad height adjusting device for sheet-fed rotary printing presses has a plurality of adjustment screws supported on an inner wall of a recess in the outer periphery of a cylinder and threadedly extending through an adjustment bar extending axially of the cylinder. A gripper pad bar on which gripper pads are mounted is disposed radially outwardly of the adjustment bar in contact therewith. The gripper pad bar and the adjustment bar are held against each other through their contact surfaces which are complementarily slanted in the transverse direction thereof. Rotatable movement of the adjustment screws causes the adjustment bar to displace the gripper pad bar radially outwardly or inwardly for stepless adjustment of the height of the gripper pads in conformity with the thickness of a sheet of paper without having to remove the gripper pad bar and other parts. Therefore, adjustment can be carried out simply and easily in a short period of time. There is no danger for dust or other foreign matter to enter the gripper pad height adjusting device, with the result that a required degree of adjustment of the height of the gripper pads will be assured, and the printing press will not experience printing difficulties which may otherwise be caused by poor adjustment accuracy.

Figure 11:
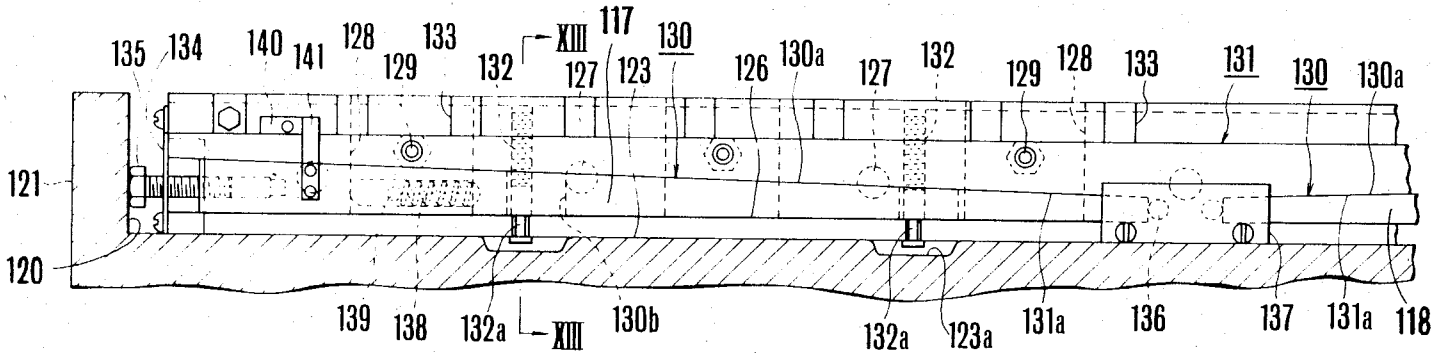
FIG. 11 is a fragmentary front elevational view of a second example of a gripper pad height adjusting device according to the present invention another embodiment, disposed in a recess in an impression cylinder of a sheet-fed rotary printing press.
Figure 12:
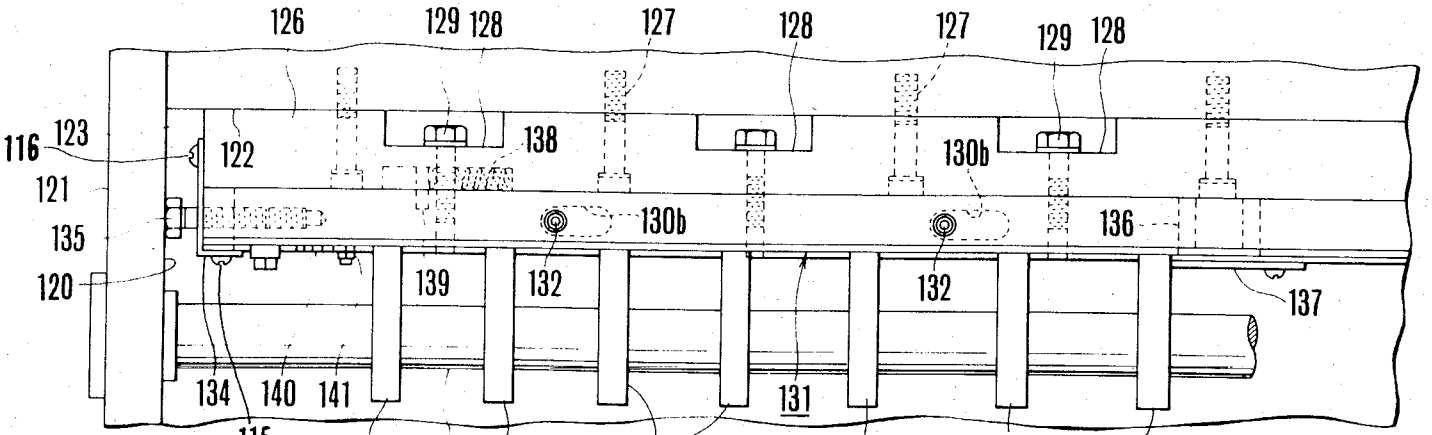
FIG. 12 is a fragmentary plan view of the device illustrated in FIG. 11.
Figure 13:
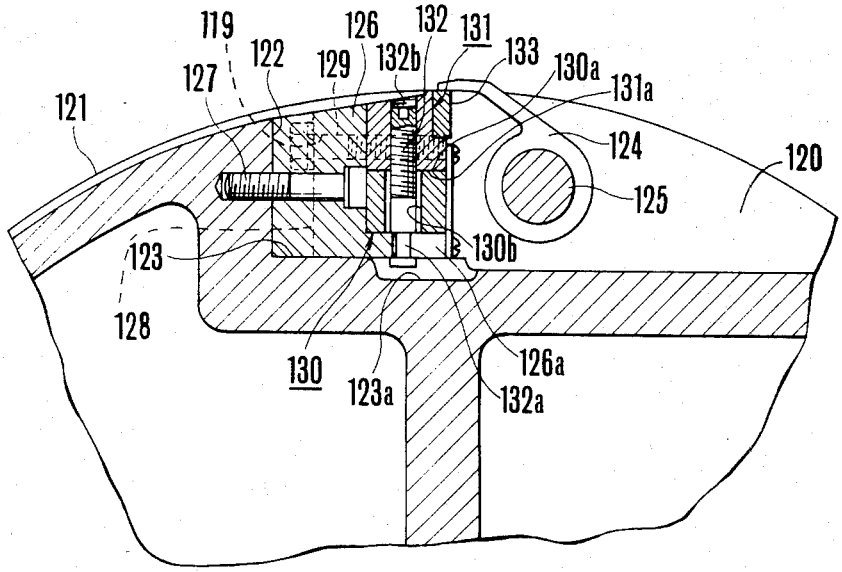
FIG. 13 is a cross-sectional view taken along line XIII—XIII of FIG. 11.

FIGS. 11 through 13 illustrate a a second example of structure of a gripper pad height adjusting device according to the present invention. An impression cylinder 121 has in its outer periphery a recess 120 extending the full length of the impression cylinder 121, the recess being defined by an inner wall 122 extending radially of the impression cylinder and a bottom surface 123 extending perpendicularly to the inner wall 122. A gripper shaft 125 is disposed in the recess and has a plurality of grippers 124 spaced at intervals along the gripper shaft 125 and openable by a cam mechanism. A gripper pad attachment bar 126 of an L-shaped cross-section extends axially of the impression cylinder 121 and is affixed to the inner wall 122 by a plurality of bolts 127. The gripper pad attachment bar 126 has a plurality of cavities 128 facing the inner wall 122 and opening to the exterior. The gripper pad attachment bar 126 has bolt holes 119 at the cavities 128. Bolts 129 are inserted through the bolt holes 119 before the gripper pad attachment bar 126 is affixed to the inner wall 122.

A gripper pad mounting member which is to be attached by the bolts 129 to an L-shaped inner wall of the gripper pad attachment bar 126, consists an adjustment bar 130 and a gripper pad bar 131 which are held in radial alignment with each other with their confronting surfaces held against each other, and bolts 132 which fasten the adjustment bar 130 and the gripper pad bar 131 together.

Figure 15:
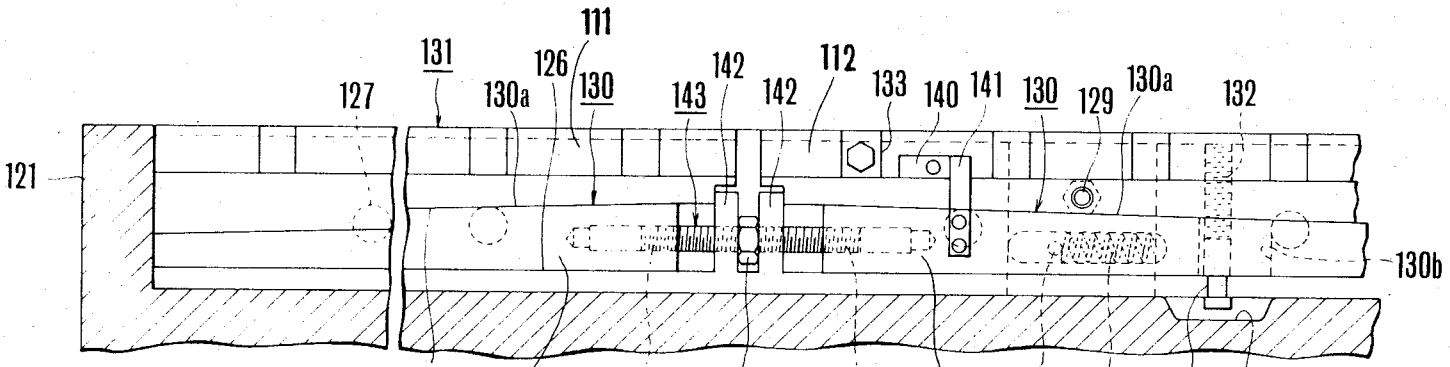
FIG. 15 is a view similar to FIG. 11, showing a third example of a gripper pad height adjusting device according to the present invention.

The adjustment bar 130 is composed of a pair of lefthand and righthand adjustment bar members 117 and 118, respectively, which extend from the longitudinal center of the adjustment bar 130 to the opposite ends thereof, as shown in FIG. 15, the adjustment bar members being symmetrical with each other. The adjustment bar members 117 and 118 have surfaces thereof held against the inner wall of the gripper pad attachment bar 126 and are supported so as to be longitudinally movable. The adjustment bar members have surfaces 130*a* abutting the gripper pad bar 131 and longitudinally slanted progressively from the outer to the inner ends.

The gripper pad bar 131 is of a length which is equal to that of the gripper pad attachment bar 126, and has surfaces 131*a* held against the surfaces 130*a* of the adjustment bar members 117 and 118, the surfaces 131*a* being longitudinally slanted so that the gripper pad bar 131 becomes progressively thinner from the opposite ends to the center thereof. The slanted surfaces 131*a* are complementary with the slanted surfaces 130*a*. Each of the bolts 132 which fasten the bars 130 and 131 together include a threaded portion extending threadedly into the gripper pad bar 131, a small-diameter lower end portion 132*a*, and a hexagonal socket 132*b* at its upper end receptive of a wrench end. The adjustment bar 130 has elongate slots 130*b* in which the bolts 132 are inserted. A plurality of gripper pads 133 are mounted on the gripper pad bar 131 in alignment with the grippers 124.

The plurality of gripper pad mounting member thus assembled has on its opposite ends L-shaped holder plates 134 temporarily fastened thereof. After adjustment screws 135 have threaded through the holder plates 134 into the adjustment bar 130, the bolts 132 are inserted into threaded engagement with the gripper pad bar 131, thereby affixing the gripper pad mounting member to the gripper pad attachment bar 126. The small-diameter end portions 132*a* of the bolts 132 engage in U-shaped slots 126*a* in the gripper pad attachment bar 126. The bolts 132 have heads disposed in recesses 123*a* in the bottom surface 123. Subsequent to the affixing, the holder plates 134 are fastened to the gripper pad attachment bar 126 by a bolt 116 and to the gripper pad bar 131 by the bolt 115. A holder plate 137 is centrally attached to the attachment bar 126 and covers a pair of stops 136 embedded in the attachment bar 126. Compression coil springs 138 are disposed respectively in elongate slots defined in opposite end portions of the gripper pad attachment bar 126, and engage pins 139 embedded in the adjustment bar 130 for urging the adjustment bar members 117 and 118 toward their opposite ends. The adjustment bar members 117 and 118 have on their outer ends pointers 141 which are positioned at scale plates 140 mounted on the gripper pad attachment bar 126.

Operation of the gripper pad height adjusting device thus constructed is as follows: The adjustment bar 130 is normally secured to the gripper pad bar 131 by the bolts 132 with the adjustment screws 135 urged by the compression coil springs 138 to hold their heads against bearers of the impression cylinder 121. When sheets of printing paper having a different thickness are to be used, the bolts 129 are slightly loosened to render the gripper pad bar 131 and the bolts 129 freely movable slightly. Thereafter, wrench ends are inserted into the hexagonal sockets 132*b* in the bolts 132 to loosen the latter, allowing the adjustment bar 130 to move back-and-forth. Rotatable movement of the adjustment screws 135 causes the adjustment bar 130 to move forwardly or rearwardly under or against the resiliency of the compression coil springs 138. At this time, the adjustment bar 130 is guided by the holder plates 134 and 137. The bolts 132 supported on the gripper pad bar 131, extend through the elongated slots 130*b* in the adjustment bar 130. Thus, back-and-forth movement of the adjustment bar 130 is not prevented. The movement of the adjustment bar 130 causes the gripper pad bar 131 to be displaced radially of the cylinder 121 through their contacting slanted surfaces 130*a* and 131*a*, thereby adjusting the height of the plurality of gripper pads 133 mounted on the gripper pad bar 131. As the amount of adjustment, that is, the amount of movement of the adjustment bar 130 can be determined by seeing the scale plates 140 and the pointers 141, the adjustment bar members 117 and 118 can be displaced equal distances while the scale plates 140 and the pointers 141 are being observed.

After such adjustment has been made, the adjustment bar 130 is prevented from moving under the bias of the compression coil springs 138. The gripper pad bar 131 can now be securely pressed against the adjustment bar 130 by tightening the bolts 132. Then, the bolts 129 are tightened to secure the gripper pad mounting member bodily to the gripper pad attachment bar 126. The adjustment process is thus completed. The stops 136 serve to define the upper limit for the height of the gripper pads 133.

The holders 134 and 137 in the above embodiments of the present invention serve to both guide back-and-forth movement of the adjustment bar 130 and to prevent dust and other foreign matter from entering the gripper pad height adjusting device.

Figure 14:
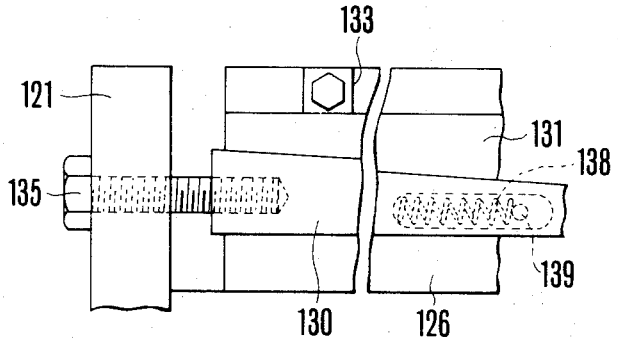
FIG. 14 is a fragmentary view of an alternate arrangement for adjusting an adjustment bar according to the present invention.

Although in the foregoing description the adjustment screws 135 are held at their heads against the inner surfaces of the bearers of the impression cylinder 121, the adjustment screws 135 may extend through the bearers of the impression cylinder 121 into threaded engagement with the adjustment bar 130 so that the adjustment screws 135 can be adjusted outwardly of the impression cylinder 121. Such an alternative is effective for those printing presses which have no cylinder driving gear disposed outwardly of the impression cylinder 121, and will be understood from FIG. 14. This modified arrangement provides a wider space available for the adjusting operation, which is thus even more easily apparent. With this arrangement, the adjustment bar members 117 and 118 are urged inwardly under the resiliency of the compression coil springs 138 to press heads of the adjustment screws 135 against outer faces of the bearers of the impression cylinder 121.

Figure 16:
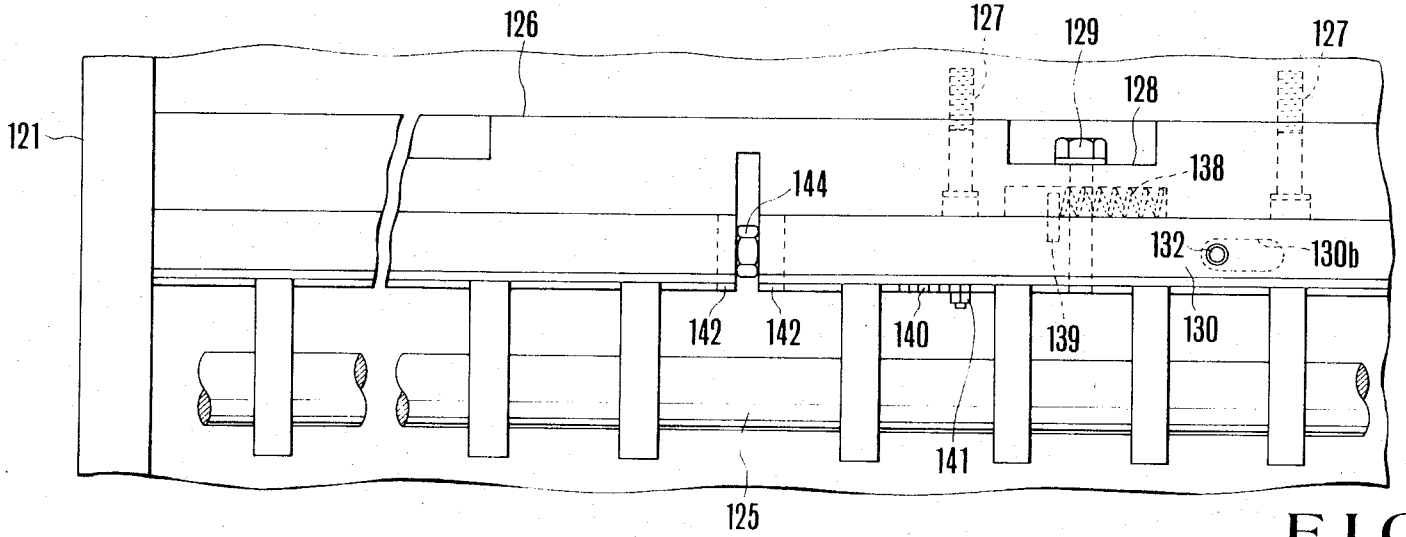
FIG. 16 is a plan view similar to FIG. 12, but illustrative of the device shown in FIG. 15.

FIGS. 15 and 16 show a third gripper pad height usting device according to the present invention. In embodiment, an adjustment screw 143 is disposed trally of an impression cylinder 121 for moving an ustment bar 130 back-and-forth.

More specifically, a gripper pad attachment bar 126 central screw supports 142 through which an adtment screw 143 is loosely inserted, and a nut 144 is ured to a central portion of the adjustment screw 3. The adjustment screw 143 is composed of a pair of hthand and lefthand threaded portions 143*a*, 143*b* t extend threadedly into the adjustment bar members 7 and 118, respectively, which are urged by the comssion coil springs 138 toward the central supports ew 142. The adjustment bar 130 and a gripper pad 131, consisting of the gripper pad bar members 111 d 112 have their contact surfaces 130*a* and 131*a* nted in opposite relation to the slanted surfaces acrding to the preceding embodiment. A scale plate 140 d a pointer 141 are located centrally of the impression linder 121. Other parts are of the same construction corresponding parts according to the foregoing emdiment, are denoted by identical reference characs, and will not be described. With this arrangement, adjustment bar members 130 can be displaced equal ervals simultaneously for easy adjustment, and the ipper pad 133 has its height rendered uniform roughout the length of the impression cylinder 121.

The above gripper pad height adjusting device with pair of adjustment bar members is generally suited medium-sized printing presses. For incorporation o small-sized printing presses, there may be provided adjustment bar 130 consisting of a single member 117 118 for coaction with a gripper pad bar 131 consistg of a single member 111 or 112, and an adjustment rew 135 attached to one end of the adjustment bar 0. The second and third gripper pad height adjusting vices of the present invention are not suitable for use ith large-sized printing presses since the slanted surces of the bars 130 and 131 are elongated, the bars 130 d 131 have increased heights at their ends, and the rs 130 and 131 have larger areas of contact, resulting a large torque required for turning the adjustment rews 135 or 143.

The gripper pad height adjusting devices of the forebing embodiments may be combined into a hybrid evice which is constructed as follows: The gripper pad ar 131 is divided into three parts or members, and the entral member is disposed in confronting relation to a air of adjustment bar members 130 with each of the uter members located in confronting relation to one djustment bar 130. With such an arrangement, adjustent can be made at three positions, that is, a central osition and outer positions. The gripper pad bar 131 ay also be divided into five members, and the adjustent bar 130 may be separated into eight members for llowing adjustment at outer positions and three central ositions. Thus, the bars 130 and 131 may be differently livided for adjustment at different positions. This alterative construction enables the gripper height adjusting levice to be incorporated into large-sized printing resses, since the bars 130 and 131 are held in contact with each other through smaller areas, with a resulting maller torque required for turning the adjustment crew 135. The gripper pads 133 have heights which are lifferent at central and outer pad positions, an arrangement which can correct or eliminate a registry error or a possible discrepancy of register between the leading and trailing portions of a sheet to be printed.

While in the foregoing embodiment the present invention is shown as being applied to an impression cylinder, it is also applicable to various other cylinders such as a sheet transfer cylinder or a sheet delivery cylinder.

With the present invention, as described above, a gripper pad height adjusting device for sheet-fed rotary printing presses includes a gripper pad attachment bar fixedly disposed in a recess in an outer periphery of a cylinder and extending axially of the cylinder. An adjustment bar having substantially the same length as the gripper pad attachment bar is movably supported for back-and-forth movement in the direction in which the gripper pad attachment bar extends, the adjustment bar being urged by a spring to move in a longitudinal direction thereof. A gripper pad bar on which gripper pads are mounted is disposed radially outwardly of the adjustment bar in parallel relation therewith. The adjustment bar and the gripper pad bar are held against each other along their surfaces which are slanted longitudinally thereof. When an adjustment screw is rotatably moved, the adjustment bar is moved longitudinally to move the gripper pad bar in the radial direction of the cylinder for stepless adjustment of the height of the gripper pads in conformity with the thickness of a sheet without requiring removal of the gripper pad bar and other components.

The adjustment can easily be effected in a short period of time by a simple operation, that is, turning the adjustment screws. Therefore, the device of the invention results in a reduced expenditure for labor and time for adjustment. There is no danger of dust or other foreign matter finding its way into the adjusting device. A required degree of accuracy in adjusting the height of the gripper pads can thus be assured, eliminating problems associated with gripper pad adjustment in printing presses. Since the gripper pad bar is supported throughout its length by the adjustment bar, the gripper pad bar is prevented from being moved slightly due to variations in the load on the grippers. With the contact surfaces slanted gradually, the adjusting device is capable of stepless fine adjustment of the height of the gripper pads until the latter are brought to an accurate desired height.

Although certain preferred embodiments have been shown and described in detail, it should be understood that various changes and modifications may be made therein without departing from the scope of the appended claims.

What is claimed as novel is as follows:

1. A gripper pad height adjusting device for adjusting a gripper pad means in relation to a plurality of grippers for gripping sheets in a sheet-fed rotary printing press, said gripper pad height adjusting device comprising:

a cylinder having a recess formed in its outer periphery;

an adjustment bar disposed in said recess and extending axially along said cylinder, said adjustment bar comprising at least two adjustment bar members each extending axially on a respective portion of said recess, said at least two adjustment bar members each comprising a first flat sloping surface;

at least one adjustment screw interconnecting said at least two adjustment bar members for simultaneously moving said at least two adjustment bar members in said axial direction in response to rotatable movement of said at least one adjustment screw for movement of said at least two adjustment bar members relative to said cylinder such as to displace each of said first flat sloping surfaces, said at least one adjustment screw extending in an axial direction relative to said cylinder;

at least one gripper pad bar disposed in said recess and extending parallel to said at least two adjustment bar members, said at least one gripper pad bar further being disposed radially outwardly of said at least two adjustment bar members; said at least one gripper pad bar further comprising at least one second flat sloping surface formed on said at least one gripper pad bar, said at least one second flat sloping surface abutting said first flat sloping surface, said first and said at least one second flat sloping surfaces sloping downwardly relative to said axial direction such that said movement of said at least two adjustment bar members in said axial direction in response to said rotatable movement of said at least one adjustment screw results in radial movement of said at least one gripper pad bar relative to said cylinder;

selectively disengageable interconnection means fixedly interconnecting said at least one gripper pad bar with said cylinder such that said at least one gripper pad bar is radially adjustably positionable relative to said cylinder by selectively disengaging said selectively disengageable interconnection means and by rotatable movement of said at least one adjustment screw to provide relative movement of said first and said at least one second flat sloping surfaces;

biasing means mechanically interposed said selectively disengageable interconnection means and said at least two adjustment bar members, said biasing means urging said first and said at least one second sloping surfaces into mutual engagement;

a plurality of gripper pads mounted on said at least one gripper pad bar, said plurality of gripper pads being adjustably positionable relative to said plurality of grippers by said radial movement of said at least one gripper pad bar; and said plurality of grippers being pivotally mounted to said cylinder, each of said plurality of grippers further being selectively engageable with a respective one of said plurality of gripper pads.

2. The gripper pad height adjusting device of claim 1 wherein said selectively disengageable interconnection means comprises a gripper pad attachment bar disposed adjacent said at least one gripper pad bar and said at least one adjustment bar; a bolt passed through an oversized hole in said gripper pad attachment bar and threaded into said cylinder and means for attaching said at least one gripper pad bar to said gripper pad attachment bar.

3. The gripper pad height adjusting device of claim 2 further comprising additional selectively disengageable interconnection means for interconnecting said at least one adjustment bar with said cylinder.

4. The gripper pad height adjusting device of claim 2 wherein said biasing means comprises:

projection means extending from said adjustment bar;

an aperture formed in said gripper pad attachment bar, said projection means extending into said aperture; and spring biasing means mechanically interposed said projection means and said aperture formed in said gripper pad attachment bar.

5. A gripper pad height adjusting device for adjusting a gripper pad means in relation to a plurality of grippers for gripping sheets in a sheet-fed rotary printing press, said gripper pad height adjusting device comprising:

a cylinder having a recess formed in its outer periphery;

at least one adjustment bar disposed in said recess and extending axially of said cylinder, said at least one adjustment bar having a first flat sloping surface;

at least one adjustment screw interconnecting said at least one adjustment bar and said cylinder, said at least one adjustment bar being responsive to rotatable movement of said at least one adjustment screw for movement of said at least one adjustment bar relative to said cylinder such as to displace said first flat sloping surface;

at least one gripper pad bar disposed in said recess and extending parallel to said at least one adjustment bar, said at least one gripper pad bar being disposed radially outwardly of said at least one adjustment bar, said at least one gripper pad bar having a second flat sloping surface, said second flat sloping surface being complementally engageable with said first flat sloping surface such that when said second flat sloping surface is placed in abutting relationship with said first flat sloping surface, said first and said second flat sloping surfaces establish a common plane along which said first and second flat sloping surfaces move relative to each other such that said movement of said at least one adjustment bar in response to said rotatable movement of said at least one adjustment screw results in radial movement of said at least one gripper pad bar relative to said cylinder;

selectively disengageable interconnection means fixedly interconnecting said at least one gripper pad bar with said cylinder such that said at least one gripper pad bar is radially adjustably positionable relative to said cylinder by selectively disengaging said selectively disengageable interconnection means and by rotatable movement of said at least one adjustment screw to provide relative movement of said first and second flat sloping surfaces;

biasing means mechanically interposed said at least one gripper pad bar and said at least one adjustment bar, said biasing means urging said first and second flat sloping surfaces into mutual engagement;

a plurality of gripper pads mounted on said at least one gripper pad bar, said plurality of gripper pads being adjustably positionable relative to said plurality of grippers by said radial movement of said at least one gripper pad bar;

means for guiding the relative movement of said first and second flat sloping surfaces whereby said movement of said at least one adjustment bar relative to said at least one gripper pad bar is accurately and smoothly guided by said guide means; and said plurality of grippers being pivotally mounted to said cylinder, each of said plurality of grippers further being selectively engageable with a respective one of said plurality of gripper pads.

6. The gripper pad height adjusting device of claim 5 wherein said first and second flat sloping surfaces each extend downwardly in a direction perpendicular to the longitudinal axis of said cylinder.

7. The gripper pad height adjusting device of claim 5 further comprising at least one gripper pad attachment bar mounted to said cylinder in said recess, said at least one adjustment bar being mounted to said at least one gripper pad attachment bar; said at least one gripper pad attachment bar further defining at least one cavity between said cylinder and said at least one gripper pad attachment bar; said at least one adjustment screw further comprising a head portion disposed in said at least one cavity and a threaded portion extending therefrom and engaging said at least one adjustment bar.

8. The gripper pad height adjusting device of claim 5 wherein said selectively disengageable interconnection means comprises a gripper pad attachment bar disposed adjacent said at least one gripper pad bar and said at least one adjustment bar; a bolt passed throgh an oversized hole in said gripper pad attachment bar and threaded into said cylinder and means for attaching said at least one gripper pad bar to said gripper pad attachment bar.

9. The gripper pad height adjusting device of claim 3 further comprising additional selectively disengageable interconnection means for interconnecting said at least one adjustment bar with said cylinder.

10. The gripper pad height adjusting device of claim 5 wherein said at least one adjustment screw extends in an approximately normal direction relative to said cylinder and further wherein said first and second flat sloping surfaces slope downwardly in a direction perpendicular to the longitudinal axis of said cylinder, said at least one adjustment bar being movable in said approximately normal direction in response to said rotatable movement of said at least one adjustment screw.

11. A gripper pad height adjusting device for adjusting a gripper pad means in relation to a plurality of grippers for gripping sheets in a sheet-fed rotary printing press, said gripper pad height adjusting device comprising:

a cylinder having a recess formed in its outer periphery;

at least one adjustment bar disposed in said recess and extending axially along said cylinder, said at least one adjustment bar having a first flat sloping surface;

at least one adjustment screw interconnecting said at least one adjustment bar and said cylinder, said at least one adjustment bar being responsive to rotatable movement of said at least one adjustment screw for movement of said at least one adjustment bar relative to said cylinder such as to displace said first flat sloping surface;

at least one gripper pad bar disposed in said recess and extending parallel to said at least one adjustment bar, said at least one gripper pad bar being disposed radially outwardly of said at least one adjustment bar, said at least one gripper pad bar having a second flat sloping surface, said second flat sloping surface being complementally engageable with said first flat sloping surface such that when said second flat sloping surface is placed in abutting relationship with said first flat sloping surface said first and second flat sloping surfaces establish a common plane along which said first and second flat sloping surfaces move relative to each other such that said movement of said at least one adjustment bar in response to said rotatable movement of said at least one adjustment screw results in radial movement of said at least one gripper pad bar relative to said cylinder;

selectively disengageable interconnection means fixedly interconnecting said at least one gripper pad bar with said cylinder such that said at least one gripper pad bar is radially adjustably positionable relative to said cylinder by selectively disengaging said selectively disengageable interconnection means and by rotatable movement of said at least one adjustment screw to provide relative movement of said first and second flat sloping surfces along said common plane;

biasing means mechanically interposed said selectively disengageable interconection means and said at least one adjustment bar, said biasing means urging said first and second flat sloping surfaces into mutual engagement;

a plurality of gripper pads mounted on said at least one gripper pad bar, said plurality of gripper pads being adjustably positionable relative to said plurality of grippers by said radial movement of said at least one gripper pad bar;

means for guiding the relative movement of said first and second flat sloping surfaces whereby said movement of said at least one adjustment bar relative to said at least one gripper pad bar is accurately and smoothly guided by said guide means; and said plurality of grippers being pivotally mounted to said cylinder, each of said plurality of grippers further being selectively engageable with a respective one of said plurality of gripper pads.

12. The gripper pad height adjusting device of claim 11 wherein said first and second flat sloping surfaces slope downwardly in a direction extending parallel to the longitudinal axis of said cylinder.

13. The gripper pad height adjusting device of claim 11 wherein said selectively disengageable interconnection means comprises a gripper pad attachment bar disposed adjacent said at least one gripper pad bar and said at least one adjustment bar; a bolt passed through an oversized hole in said gripper pad attachment bar and threaded into said cylinder and means for attaching said at least one gripper pad bar to said gripper pad attachment bar.

14. The gripper pad height adjusting device of claim 13 wherein said biasing means comprises:

projection means extending from said at least one adjustment bar;

an aperture formed in said at least one gripper pad attachment bar, said projection means extending into said aperture; and spring biasing means mechanically interposed said projection means and said aperture formed in said at least one gripper pad attachment bar.

15. The gripper pad height adjusting device of claim 11 wherein said at least one adjustment bar comprises at least two adjustment bar members, each having a first flat sloping surface engaging said second sloping surface of a respective one of said at least one gripper pad bar.

16. The gripper pad height adjusting device of claim 11 further comprising abutment means extending from said cylinder and preventing displacement of said at least one adjustment bar beyond a predetermined extreme position.

17. The gripper pad height adjusting device of claim 16 further comprising shield means extending from said at least one adjustment bar, said shield means substantially surrounding said abutment means to protect said abutment means from debris.

18. The gripper pad height adjusting device of claim 11 further comprising at least one gripper pad attachment bar mounted to said cylinder in said recess, said at least one gripper pad attachment bar being mounted to said at least one gripper pad bar and said at least one adjustment bar; said at least one adjustment bar further defining a recess between said cylinder and said at least one adjustment bar; said at least one adjustment screw further comprising a head portion disposed in said recess and a threaded portion extending therefrom and engaging said at least one adjustment bar.

19. The gripper pad height adjusting device of claim 11 further comprising additional selectively disengageable interconnection means for interconnecting said at least one adjustment bar with said cylinder.

20. The gripper pad height adjusting device of claim 11 further comprising abutment means extending from said cylinder and preventing displacement of said at least one adjustment bar beyond a predetermined extreme position.

21. The gripper pad height adjusting device of claim 20 further comprising shield means extending from said at least one adjustment bar, said shield means substantially surrounding said abutment means to protect said abutment means from debris.

22. A gripper pad height adjusting device for adjusting a gripper pad means in relation to a plurality of grippers for gripping sheets in a sheet-fed rotary printing press, said gripper pad height adjusting device comprising:

a cylinder having a recess formed in its outer periphery;

at least one adjustment bar disposed in said recess and extending axially of said cylinder, said at least one adjustment bar having a first flat sloping surface;

at least one adjustment screw interconnecting said at least one adjustment bar and said cylinder, said at least one adjustment bar being responsive to rotatable movement of said at least one adjustment screw for movement of said at least one adjustment bar relative to said cylinder such as to displace said first flat sloping surface;

at least one gripper pad bar disposed in said recess and extending parallel to said at least one adjustment bar, said at least one gripper pad bar further being disposed radially outwardly of said at least one adjustment bar, said at least one gripper pad bar having at least one second flat sloping surface, an aperture extending through said at least one second flat sloping surface and a recess integrally formed with said aperture; said at least one second flat sloping surface being complementally engageable with said first flat sloping surface such that when said at least one second flat sloping surface is placed in abutting relationship with said first flat sloping surface, said first and said at least one second flat sloping surfaces establish a common plane along which said first and said at least one second flat sloping surfaces move relative to each other such that said movement of said at least one adjustment bar in response to said rotatable movement of said at least one adjustment screw results in radial movement of said at least one gripper pad bar relative to said cylinder;

selectively disengageable interconnection means fixedly interconnecting said at least one gripper pad bar with said cylinder such that said at least one gripper pad bar is radially adjustably positionable relative to said cylinder by selectively disengaging said selectively disengageable interconnection means and by rotatable movement of said at least one adjustment screw to provide relative movement of said first and said at least one second flat sloping surfaces;

spring means mechanically interposed said at least one gripper pad bar and said at least one adjustment bar, said spring means urging said first and said at least one second flat sloping surfaces into mutual engagement, said spring means further comprising:

elongated fastener means having a first end selectively interconnectable with said at least one adjustment bar, said elongated fastener means extending approximately radially relative to said first flat sloping surface when selectively interconnected therewith, said elongated fastener means further having an enlarged head disposed remote from said first end, said enlarged head being disposed in said recess;

said aperture in said at least one gripper pad bar being larger than said first end of said elongated fastener means but smaller than said enlarged head;

helical biasing means having an inner diameter larger than said first end of said elongated fastener means but smaller than said enlarged head; whereby said first end of said elongated fastener means is passed progressively through said helical biasing means and said aperture before being interconnected with said at least one adjustment bar;

a plurality of gripper pads mounted on said at least one gripper pad bar, said plurality of gripper pads being adjustably positionable relative to said plurality of grippers by said radial movement of said at least one gripper pad bar;

means for guiding the relative movement of said first and said at least one second flat sloping surfaces whereby said movement of said at least one adjustment bar relative to said at least one gripper pad bar is accurately and smoothly guided by said guide means; and said plurality of grippers being pivotally mounted to said cylinder, each of said plurality of grippers further being selectively engageable with a respective one of said plurality of gripper pads.

23. The gripper pad height adjusting device of claim 22 wherein said at least one adjustment screw extends in an approximately normal direction relative to said cylinder and further wherein said first flat and at least one second flat sloping surfaces slope downwardly in a direction perpendicular to the longitudinal axis of said cylinder, said at least one adjustment bar being movable in said approximately normal direction in response to said rotatable movement of said at least one adjustment screw.

24. The gripper pad height adjusting device of claim 22 further comprising at least one gripper pad attachment bar mounted to said cylinder in said recess, said at least one adjustment bar being mounted to said at least one gripper pad attachment bar; said at least one gripper pad attachment bar further defining at least one cavity between said cylinder and said at least one gripper pad attachment bar; said at least one adjustment screw further comprising a head portion disposed in said at least one cavity and a threaded portion extending therefrom and engaging said at least one adjustment bar.

25. The gripper pad height adjusting device of claim 22 wherein said first flat and at least one second flat sloping surfaces each extend downwardly in a direction perpendicular to the longitudinal axis of said cylinder.

26. The gripper pad height adjusting device of claim 22 wherein said selectively disengageable interconnection means comprises:

a gripper pad attachment bar disposed adjacent said at least one gripper pad bar and said at least one adjustment bar; and a bolt passed through an oversized hole in said gripper pad attachment bar and threaded into said cylinder and means for attaching said at least one gripper pad bar to said gripper pad attachment bar.

27. The gripper pad height adjusting device of claim 26 further comprising additional selectively disengageable interconnection means for interconnecting said at least one adjustment bar with said cylinder.

* * * * *